US008668106B1

(12) United States Patent
Joy et al.

(10) Patent No.: US 8,668,106 B1
(45) Date of Patent: Mar. 11, 2014

(54) FLUID CONTAINER COVER

(71) Applicant: Lifefactory, Inc., Sausalito, CA (US)

(72) Inventors: Daren Joy, Sausalito, CA (US); Kazuna Tanaka, Cos Cob, CT (US); Jeffrey Kapec, Westport, CT (US)

(73) Assignee: Lifefactory, Inc., Sausalito, CA (US)

( * ) Notice: Subject to any disclaimer, the term of this patent is extended or adjusted under 35 U.S.C. 154(b) by 0 days.

(21) Appl. No.: 13/781,758

(22) Filed: Mar. 1, 2013

Related U.S. Application Data

(60) Provisional application No. 61/728,452, filed on Nov. 20, 2012.

(51) Int. Cl.
*A47G 19/22* (2006.01)

(52) U.S. Cl.
USPC ..... 220/254.3; 220/715; 220/717; 220/708; 222/536; 222/568

(58) Field of Classification Search
USPC ..... 220/254.3, 703, 705, 708, 715, 717; 222/536, 566, 568; 215/388
See application file for complete search history.

(56) References Cited

U.S. PATENT DOCUMENTS 4,776,501 A * 10/1988 Ostrowsky ..... 222/517
4,852,762 A 8/1989 Chou-Sheng
5,065,909 A 11/1991 Pino et al.
5,085,336 A * 2/1992 Lynd ..... 220/708
5,392,968 A 2/1995 Dark
5,582,315 A 12/1996 Reid
5,746,338 A 5/1998 Takahashi et al.
5,873,476 A 2/1999 Takahashi et al.
5,873,478 A 2/1999 Sullivan et al.
6,021,801 A 2/2000 Sheppard
6,116,458 A 9/2000 Dark
6,390,341 B1 5/2002 Ohmi et al.
7,533,783 B2 5/2009 Choi et al.
7,913,869 B2 3/2011 Cuocolo, Jr.
7,931,166 B2 4/2011 Cuocolo, Jr.
8,191,727 B2 6/2012 Davies et al.
2011/0198361 A1 8/2011 Chen
2012/0181303 A1* 7/2012 Swanick ..... 222/83
2012/0187075 A1 7/2012 El-Saden et al.

* cited by examiner

*Primary Examiner* — Anthony Stashick
*Assistant Examiner* — James N Smalley
(74) *Attorney, Agent, or Firm* — The Mueller Law Office, P.C.

(57) ABSTRACT

A fluid container includes a spout and a cap, where the spout has an actuation portion that is inclined with respect to a drinking portion of the spout. The spout is actuated from a closed position to an open position with an external force applied on the actuation portion. A channel through the spout encompasses an oblique angle, and the spout is pivotally coupled to the cap at a fulcrum point. The fulcrum point is laterally offset from an aperture in the cap, where the aperture forms a passageway through a thickness of the cap. The channel adjoins the aperture when the spout is in the open position.

19 Claims, 5 Drawing Sheets

FLUID CONTAINER COVER

RELATED APPLICATIONS

This application claims priority to U.S. Provisional Patent Application No. 61/728,452 filed Nov. 20, 2012 and entitled "Straw Cap Bottle", which is hereby incorporated by reference for all purposes.

BACKGROUND

Active lifestyles necessitate that those who engage in them constantly be on the go. Good health demands that those participating in such active living imbibe a large quantity of liquids, such as water and other well-known sports drinks. Being on the go, however, often presents the problem of needing to quench one's thirst and yet not having access to a source of liquid refreshment. Accordingly, fluid containers, such as drinking bottles, have been developed to meet such demands of active living and thereby enable those who would not ordinarily have access to liquid refreshment to store, transport and make use of such refreshments at their convenience.

Portable drinking bottles have increased in popularity over the years not only because of increasingly active lifestyles, but also due to environmental concerns with disposable bottles. For example, replacing disposable water bottles with a single beverage container that may be cleaned and refilled many times greatly reduces the amount of waste produced. Fluid containers which can meet the needs of a person's or a family's activities while also being reusable is an increasingly growing market.

Drinking bottles are used by all ages—from children through adults—and in many situations. For example, these bottles are used for travel, recreation, sports, school and everyday activities. Straws or spouts that flip open on a bottle cover are known in the art. Conventional designs involve pulling the tip of the spout upward with one's finger, with the spout pivoting at its lower end where it is attached to the cap. These designs often require two hands to open the bottle—one hand to hold the bottle and the other hand to pull open the spout. Other designs have included rotating covers to fold and enclose a spout, push button actuation in which a spring assembly pops open the spout, or a flange or loop on the spout to assist a user in pulling the spout upward.

SUMMARY

A fluid container includes a spout and a cap, where the spout has an actuation portion that is inclined with respect to a drinking portion of the spout. The spout is actuated from a closed position to an open position with an external force applied on the actuation portion. A channel through the spout encompasses an oblique angle, and the spout is pivotally coupled to the cap at a fulcrum point. The fulcrum point is laterally offset from an aperture in the cap, where the aperture forms a passageway through a thickness of the cap. The channel adjoins the aperture when the spout is in the open position.

DETAILED DESCRIPTION

A cover for a fluid container is described herein. The cover includes a straw and a cap, and the straw pivots upward from a cap. The straw, which may also be referred to as a spout in this disclosure, features a raised actuation area that facilitates the ease of opening the spout. The cover is also designed to provide improved leverage for opening the spout without sacrificing the spout's drinking length. While the design of the cover and method of opening shall be described in reference to a personal beverage bottle, the design and method can be used on a variety of devices for drinking or dispensing fluids. For instance, other applications may include pitchers, jugs, hot/cold drink dispensers, fluid storage containers, or other hydration systems that could be used to pour liquids in situations where lengthened spouts or ease of opening could be beneficial.

The present disclosure describes a pivoting spout that is actuated by a pushing force, and is conducive to a one-handed operation. The actuation area may be an upwardly angled back end that is easily reachable by various users, including those with smaller hands. A drinking channel through the spout has an angle through the spout, corresponding to the angled back end. The ability to open the drinking bottle with a single hand is a valuable feature for busy or physically active consumers because they can more easily stay hydrated while in the midst of their activities. The fulcrum point of the spout is specifically designed to increase leverage, to reduce the force required to open the spout and increase user-friendliness. The spout may be seated in a raised depression that allows increasing the length of the spout while adding minimal additional material, thereby avoiding significant increases in costs. The design lengthens the spout to allow for easier drinking without increasing the total height of the cap, while still allowing sufficient space in the cap for the threads that are needed to attach the cap to the bottle. The raised depression also encloses the end of the spout, keeping the spout cleaner, and furthermore provides an aesthetically pleasing design in that the overall height of the cap visually appears the same as without the raised depression. The location of the axis/fulcrum point and the angled spout actuation area relative to the drinking portion of the spout allow a user to gain easier leverage and open the spout with one hand.

Figure 1:
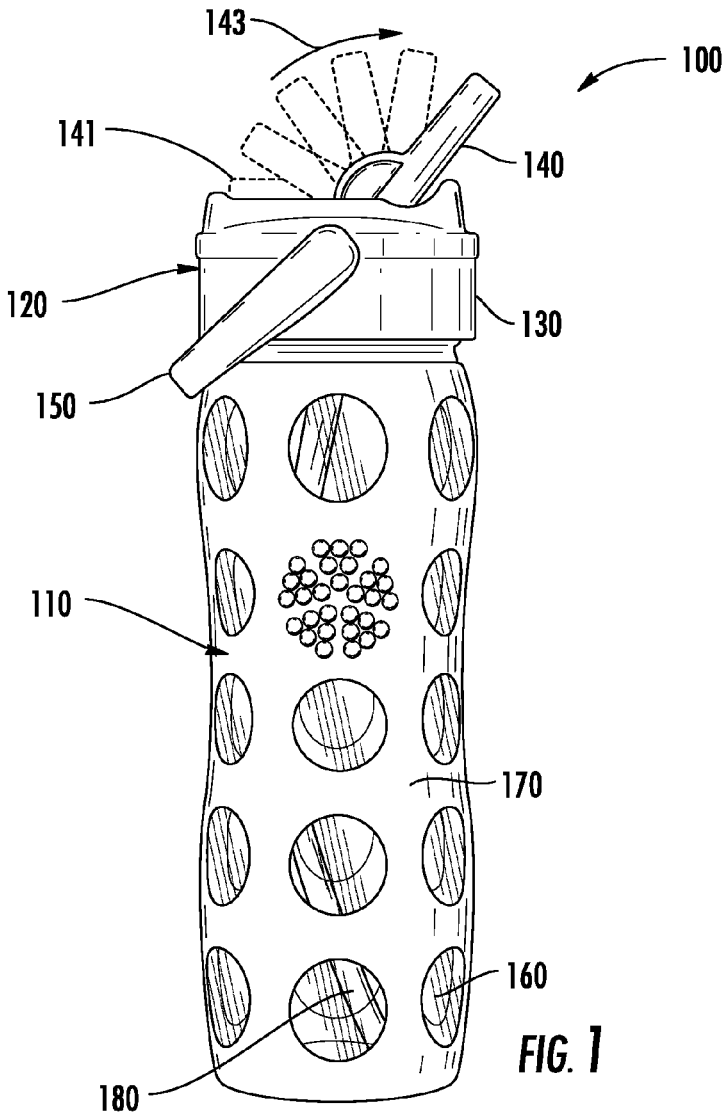
FIG. 1 shows a side view of an exemplary bottle with an embodiment of a straw cap assembly.

FIG. 1 is a side view of an exemplary drinking bottle assembly 100 in one embodiment. The bottle assembly 100 includes a bottle assembly 110 and a cover 120, where the cover includes cap 130, straw or spout 140, and optional handle 150. The bottle assembly 110 includes a bottle 160 and an optional sleeve 170. Bottle 160 may be made of, for example, glass or plastic, and furthermore may be free of bisphenol A (BPA), phthalates, polyvinyl chloride (PVC) or other chemicals. Glass and clear plastics enable a user to see the contents and level of fluid inside the bottle 160, as well as to view the cleanliness of the interior of the bottle. Glass also provides a safe material, in that it is free of any materials leaching from it compared to, for example, some plastics.

In the embodiment shown in FIG. 1, an optional sleeve 170 may be placed over the bottle 160 to protect the bottle 160 from damage and to enhance gripping of the bottle. The sleeve 170 may be made of, for example, silicone or other suitable materials. In some embodiments, the sleeve 170 may be a protective sleeve such as that disclosed in U.S. Patent Publication No. 2009/0057257, entitled "Protective Sleeve for Containers", published Mar. 5, 2009, and hereby incorporated by reference for all purposes.

A drinking tube 180 allows liquid to be pulled from bottle 110 through cap 120 and out of spout 140. The drinking tube 180 may be fabricated from, for example, plastic or glass, and furthermore may be free of bisphenol A (BPA), phthalates, polyvinyl chloride (PVC) or other chemicals. FIG. 1 shows that spout 100 moves between a closed position 141 to the open position as shown by spout 140, through a pivoting motion as indicated by arrow 143. The spout 140 rotates in an approximately vertical plane with respect to the plane of the cap 130. In this embodiment, its final position of spout 140 forms an oblique angle from its horizontal starting position, for easy drinking access to the user. In some embodiments, the oblique or non-vertical position of the spout 140 in the open position facilitates ease of drinking for the user while keeping the bottle comfortable in the user's hand. For example, the design of the spout 140 angles the tip toward the user's mouth without the user having to tip the bottle 110 for drinking. In other embodiments, the spout 140 may also have a length that overhangs or extends past the diameter of the cap 120 in the open position. This clearance between the drinking end of the spout 140 and the cap 120 created by this overhang may provide additional ease of drinking for the user. The spout in its sipping position may be, for example, rotated up to 135° or more from its initial closed position. Other values of rotation angles are possible for different uses of the bottle, such as for children rather than adults, or for use in specific sports. Note that the closed position 141 is shown as approximately horizontal in this embodiment. However, in other embodiments the closed position may be inclined, such as elevated above or declined below the plane of cap 120.

Figure 2:
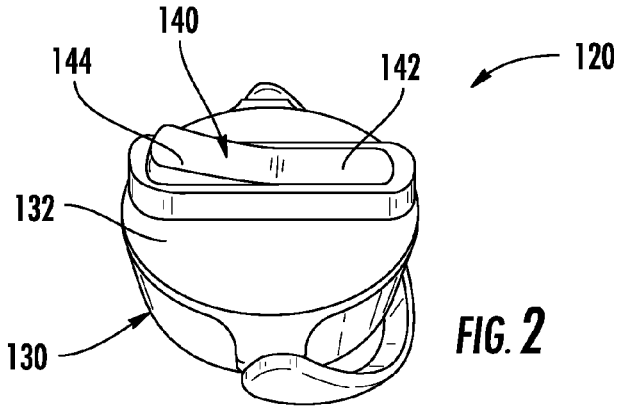
FIG. 2 is a top perspective view of the cover of FIG. 1.
Figure 3:
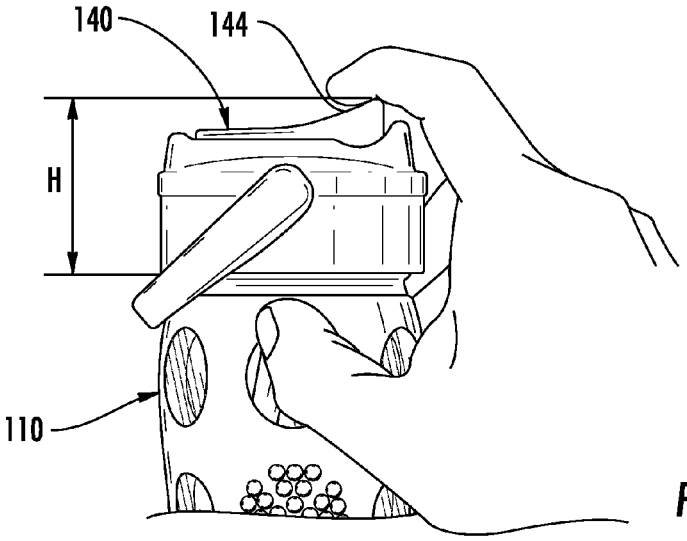
FIG. 3 depicts a user actuating the spout from a closed position, in one embodiment.

FIG. 2 shows a top perspective view of the cover 120 with the spout 140 in the closed position. The spout 140 has a drinking portion 142 and an actuation portion 144. As can be seen in FIG. 2, actuation area 144 at the back end of the spout 100 is higher than the rest of the spout 140 when closed. That is, the height of the actuation area is elevated above the top surface 132 of the cap 130 in the closed position. This raised actuation area improves the leverage compared to a spout that would be a uniform height across the entire width of the cap. In operation, a user pushes downward on this actuation area 144 as shown in FIG. 3, which then lifts the tip of the spout 140 upward to enable a user to drink from a drinking channel in spout 100. In some embodiments, a user's finger may push downward to rotate the spout partially towards its final open position, and then the user may place their mouth on the tip of the spout to rotate it the remainder of the way.

In the exemplary method of operation of the spout shown in FIG. 3, the design of the cap enables a user to hold the bottle 110 with one hand and use a finger of the same hand to engage the actuation area of the spout. In the embodiment shown in FIG. 3, the user's index finger is lifted onto the cap, and presses downward on the raised actuation portion 144 at the back end of the spout. The height 'H' from the bottom edge of the cap to the top of the actuation area 144 is designed to enable a user to easily reach the top of the actuation area while maintaining their grip on the bottle with the same hand. The height 'H' from the bottom edge of the cap to the top of the actuation area may be, for example, less than 6.5 cm, such as 4.0-5.5 cm, or such as 4.0-4.5 cm. In other embodiments the height 'H' may be adjusted for specific demographics, such as being designed for a smaller reach of women or children.

Figure 4:
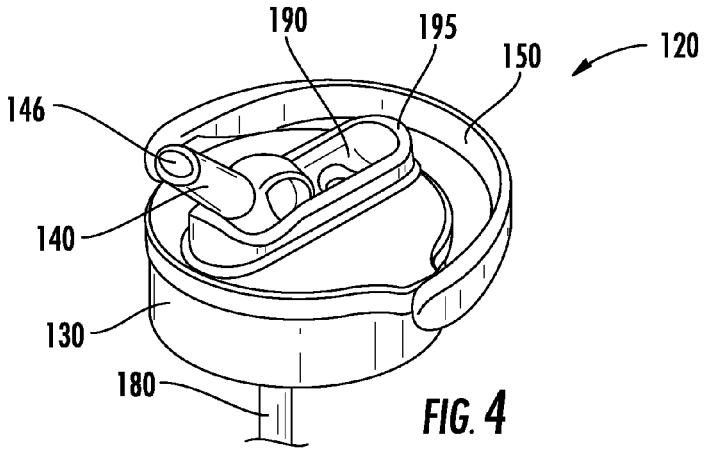
FIG. 4 illustrates a perspective view of an exemplary cover assembly, with the spout in an open position.
Figure 5:
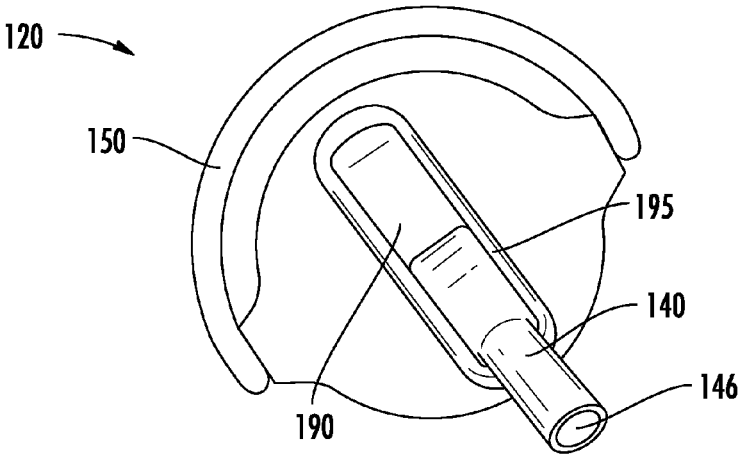
FIG. 5 is a top view of the cap assembly of FIG. 4.

FIGS. 4 and 5 provide further views of an exemplary cover or cap assembly 120, which in this embodiment includes the drinking tube 180 through which liquid from the bottle will be drawn when a user drinks from the spout. FIG. 4 shows a perspective view of the spout 140 in an open position, while FIG. 5 illustrates a top view. In FIGS. 4 and 5 a drinking channel 146 in the spout 140 is visible at the tip of the spout 140, and a depression 190 for receiving the spout 140 can also be seen. This depression 190 receives spout 140, where spout 140 is pivotally coupled to depression 190. Depression 190 may have a raised lip 195 around some or all of depression 190. Raised lip 195 may, for example, surround the tip of spout 140 when the spout 140 is closed, thus promoting cleanliness of the drinking area.

The embodiments depicted in FIGS. 1-5 include an optional handle 150. The handle 150 is positioned on an outside perimeter of the cap 130. Compared to other known designs in which a loop or handle may be incorporated on the top surface of a cap, or even as part of the spout or mouthpiece, placing the handle on the side surfaces, at the perimeter of the cap, allows for a wider radius handle and thus more gripping space for a user. Placing the handle 150 separately from the mouthpiece or straw 140 also reduces the risk of opening the bottle while it is carried, particularly if the container is being swung back and forth by a child or by an adult undergoing physical activities. The handle 150 may be coupled to the cap 130 using, for example, protrusions fitting into mating holes, fasteners such as pins, loops at the ends of the handle placed through slots in the cap, or by other suitable methods.

Figure 6:
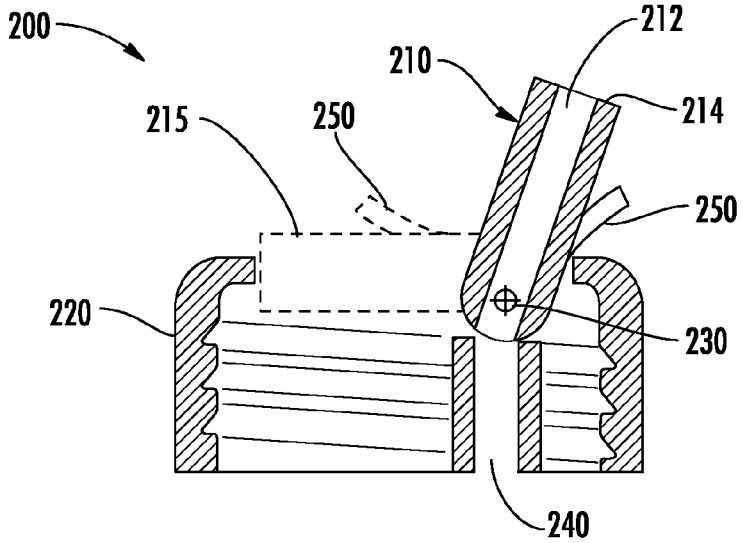
FIG. 6 (PRIOR ART)
FIG. 6 shows a cross-sectional view of fluid container designs in the art.

Now turning to details of the straw and cap design, FIG. 6 shows a cross-sectional schematic of a drinking bottle cover 200 that is representative of known bottle covers with pivoting straws. In prior art designs, a spout 210 pivots in a cap 220 at a pivot point 230, indicated by the cross-hair symbol. The spout 210 is shown in its open position, with the dashed lines showing it in a closed position 215. A drinking channel 212 runs through spout 210. The pivot point 230 is directly over—that is, vertically aligned with—an aperture 240. Aperture 240 serves as the passageway through which liquid is brought from the bottle (not shown), through the cap 220, and out of the spout 210. With this pivoting arrangement, the spout 210 is typically opened with a pulling action, such as using tab 250. In other prior art examples not shown, a user may pull up spout 210 with a loop attached to the spout 210, or a user's finger may engage tip 214 to pull up spout 210. This pulling action requires a two-handed operation because of the force required to open the spout, and because of the distance that a user's finger must extend to reach tab 250 or other engagement area. That is, to gain enough leverage to pull the spout 210 upward, the engagement point must be positioned toward tip 214, which increases the reach required for a user. In another type of prior art design, not shown, a spring-loaded mechanism is triggered by a push button on a vertical side wall of the cap, thus allowing one-handed opening of a drinking straw. However, this push button/spring-loaded design requires numerous parts, which adds cost.

Figure 7:
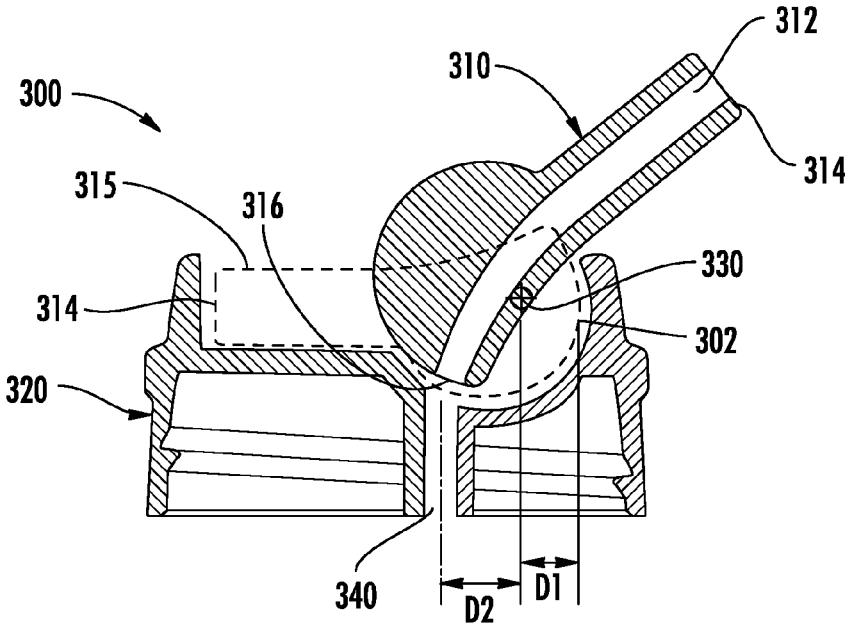
FIG. 7 illustrates a cross-sectional view of a cover assembly in one embodiment.

FIG. 7 illustrates a simplified cross-sectional view of a cover assembly 300 in one embodiment of the present disclosure. The cover assembly 300 includes a spout 310 and a cap 320, where spout 310 is shown in an open position for drinking, and where the dashed lines show spout 310 in a stored or closed position 315. The spout 310 has a drinking channel 312 through its body, extending from a drinking end 314 to an actuation end 316. Spout 310 rotates at a pivot point or fulcrum point 330 that is positioned at a fulcrum distance D1 from a back end 302 of the spout, wherein the back end 302 is the opposite the drinking end 314. The distance D1 between fulcrum point 330 and actuation end 316 enables a user to gain sufficient leverage to open the spout 310 by a pushing action, which is more conducive to one-handed operation than pulling. In contrast, a design in which the fulcrum point is simply moved toward the tip of a linear spout—such as if the fulcrum point 230 in FIG. 6 were moved toward tip 214—would decrease the usable length of the spout. In the present embodiment of FIG. 7 the actuation portion of spout 310 is angled or inclined relative to channel 312 to compensate for the location of the fulcrum point 330. The angled design increases the length of the drinking portion of spout 310 and the length available for actuation, compared to a linear spout. Accordingly, the channel 312 is non-linear, in that an axis running through its center has a bend in it. To accommodate this angled spout design, aperture 340 is laterally offset from pivot point 330 by the offset distance D2, where D2 is greater than zero. When in the open position as shown, channel 312 adjoins aperture 340 so that aperture 340 can serve as a conduit through which fluid is brought from an adjoining bottle through spout 310.

The fulcrum distance D1 and offset distance D2 beneficially provide for increased leverage compared to known pivoting spout designs, and enables a user to actuate the spout with a pushing action in a one-handed operation. This improves ease of use over existing designs in which a pulling action is required, often with two hands. Additionally, the number of parts for enabling this actuation is reduced compared to, for example, one-handed designs that operate using spring mechanisms. Also shown in FIG. 7 is that the angle and length of the spout may enable the tip 314 to overhang the edge of the cap in some embodiments, which can also provide more comfort to the user compared to the open spout tip being over the surface of the cap.

Figure 8:
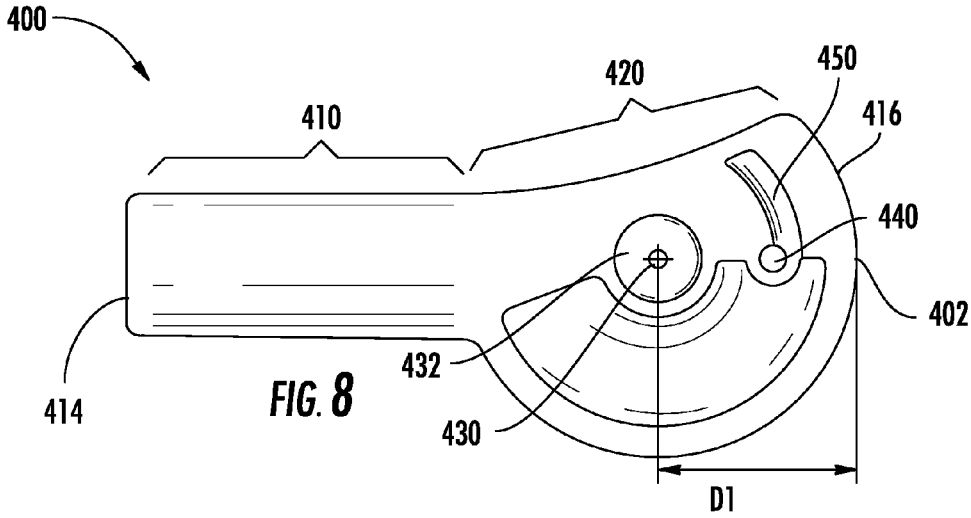
FIG. 8 is a detailed side view of one embodiment of a spout.
Figure 9A:
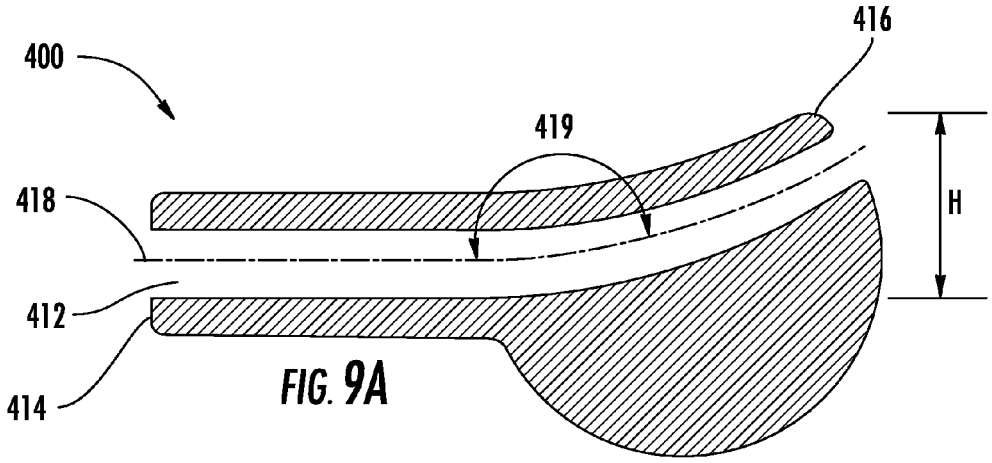
FIGS. 9A-9B are cross-sectional views of embodiments of the spout of FIG. 8.
Figure 9B:
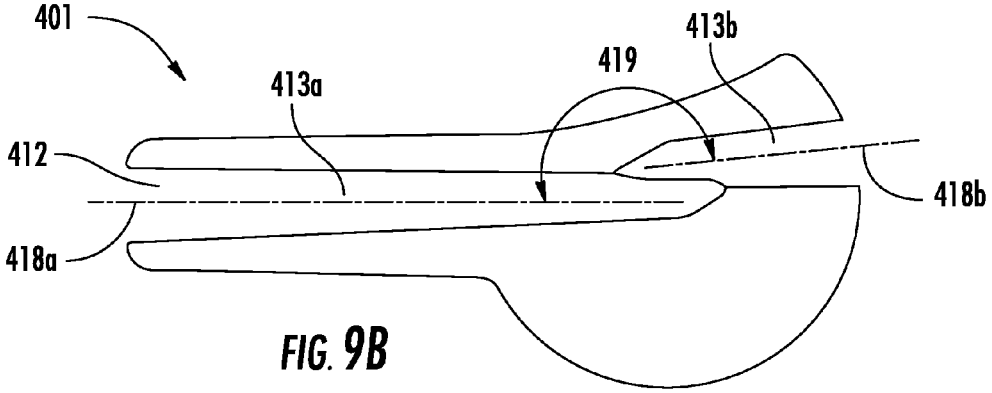

FIGS. 8 and 9A-B show side and cross-sectional views, respectively, of an embodiment of a spout 400. In FIG. 8, straw or spout 400 has a drinking portion 410, where a user will place their mouth for drinking, and an actuation portion 420, where a user pushes to open the spout 400. The combination of the drinking portion 410 and actuation portion 420 shall be referred to in this disclosure as the spout length. Note that for usages in which the fluid container cover may be used for dispensing, drinking portion 410 may function as a spout for pouring liquid. A channel 412, shown in FIG. 9A, runs through spout 400, from a drinking end 414 to an actuation end 416. Channel 412 may be configured with various cross-sectional shapes, such as circular, ovular or rectangular. An axis 418 through the center of channel 412 in FIG. 9A is seen to be non-linear—that is, having a bend in it—so that axis 418 encompasses an oblique angle 419. In other words, the two ends of channel 412 are offset from each other. Angle 419 may be chosen to achieve a desired height for actuation. Oblique angle 419 may be up to 180 degrees, such as between 150-180 degrees. While the path of channel 412 is shown as forming a curved or non-linear path, in other embodiments the channel 412 may have an axis that is formed with two linear segments intersecting to define the angle 419. FIG. 9B shows another embodiment of a spout 401, in which the channel 412 has two portions 413*a* and 413*b* with axes 418*a* and 418*b*, respectively. In this embodiment, portions 413*a* and 413*b* have cross-sectional areas that are tapered toward the central portion of spout 401, and overlap in this central portion. The axes 418*a* and 418*b* are offset from each other but still form the oblique angle 419. The angled channel 412 increases the usable length available along spout 400, compared to a linear spout having the same horizontal length as channel 412. This increased usable length allows for more surface area that can be used for actuating the spout. Thus, the angled channel design increases the leverage that a user is able to impart on the spout 400, improving the ease of use and functionality of the fluid container cover.

FIG. 8 also shows features of spout 400 that enable it to rotate between its stored and drinking positions. In this embodiment, a raised disk 432 serves as a coupling element to pivotally connect spout 400 to a cap. Raised disk 432 is depicted in FIG. 8 as a circular extension centered on the fulcrum point 430 of the spout 400. Another raised disk 432 is placed on the opposite face (not shown) of the spout 400. In other embodiments, the raised disk 432 may be replaced by other rotational joining mechanisms, such as but not limited to, a pin or a bearing. Furthermore, the male/female coupling between spout 400 and the cap in which it is placed may be interchangeable. For example, the raised disk 432 on spout 400 may be seated in a corresponding recessed seat in the cap, or alternatively, spout 400 may have a recessed seat and the raised disk may be on the cap. Spout 400 also includes a protrusion 440 shown as a nub in this embodiment, that travels in a track in the cap and limits the extent of rotation of the spout 400 when moving between its closed and open positions. An optional groove extension 450 adjacent to protrusion 440 is also shown in this embodiment, which lengthens the amount of rotation through which the spout can move.

Still referring to FIG. 8, the fulcrum distance D1 is measured from the fulcrum point 430 to a back end 402 of spout 400. Back end 402 is taken to be the farthest end of the spout 400 from the drinking end 414, taken along a line parallel to the axis of the drinking portion 410. D1 may be, for example, 0.5 to 2.0 cm, with the value chosen to meet desired specifications such as actuation forces, target customers (e.g., adult or child), and cap diameter (e.g. bottle sizes). In terms of the actuation portion 420 where a user will be placing a finger to open the spout, the actuation area 420 may have a length of, for example, 2-6 cm, although other values are possible depending on the desired size of the spout and cap. In some embodiments, the length of actuation area 420 may be determined by the size of the rotational portion of the spout 400. For example, actuation area 420 may have a length approximately equal to twice the fulcrum distance D1. The specific values chosen depend on the specifications for the particular type of container and user being targeted.

Figure 10:
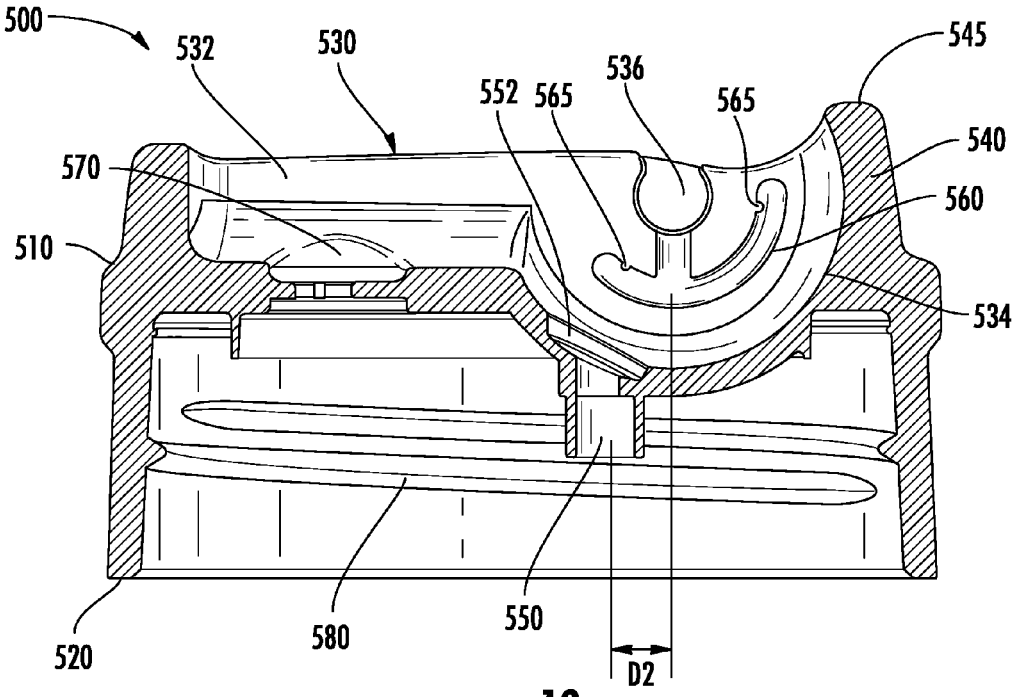
FIG. 10 provides a cross-sectional view of an exemplary cap.
Figure 11:
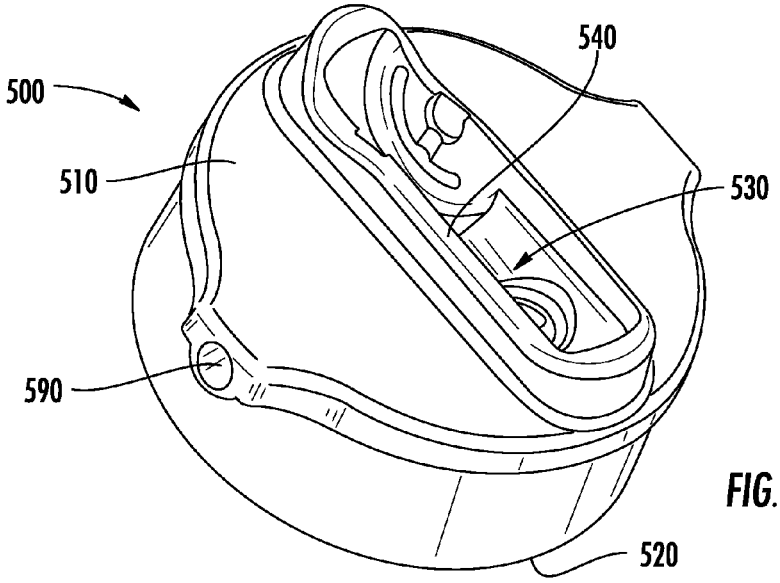
FIG. 11 is a top perspective view of the cap of FIG. 10.

FIGS. 10 and 11 illustrate a vertical cross-sectional view and a top perspective view, respectively, of one embodiment of a cap 500. Cap 500 includes a top surface 510, a bottom surface 520, a depression 530, a raised lip 540, and an aperture 550. Depression 530 is shaped to receive a spout, such as spout 400 of FIG. 8. In the embodiment shown, depression 530 includes an elongated area 532 for the drinking portion of the spout and a pivoting area 534 for the actuation portion of the spout. As a spout pivots on the cap, the actuation area of the spout rotates within pivoting area 534. In some embodiments a user's finger may push the actuation area of the spout partially into the pivoting area 534, and then the user may place their mouth on the tip of the spout to move the spout to its final position. Although pivoting area 534 is shown as a rounded track, in other embodiments the pivoting area 534 may be shaped otherwise to provide sufficient space for the actuation area of the spout to rotate, but need not be rounded.

A coupling element 536 in depression 530 serves to pivotally engage the spout. In this embodiment, the coupling element 536 is shown as a recessed area to mate with the raised disk 432 of FIG. 8. In other embodiments, the coupling element 536 may be configured as, for example, a pin joint or a ball joint. A groove 560 in depression 530 receives protrusion 440 of FIG. 8. When a user pushes on the actuation area of the spout, the protrusion 440 on the spout slides in groove 560 in the side walls of the depression 530. The additional groove 450 on the spout may optionally provide extended pivoting motion of the spout. The nubs 565 near the ends of groove 560 serve as stops for the rotation of the spout, by engaging protrusion 440 and therefore assisting in locking the spout in its open and closed positions. In other embodiments, other mechanisms may be used as stops instead of nubs 565. For example, the groove 560 may terminate in an L-shaped end to secure the spout, or the end wall 545 of raised lip 540 may provide a stopping surface for the spout in its open position.

Aperture 550 in FIG. 10 is a passageway allowing fluid to pass through the thickness of the cap 550, from the underside of cap 500 to depression 550. Aperture 550 is configured as a tubular channel in this embodiment, extending from the pivoting area 534 of the through the base of the cap, for connecting a tube or straw into the bottle that will be attached to the cap 500. Aperture 550 is vertically unaligned with coupling element 536, being laterally offset by the distance D2. This offset accommodates the oblique angle of the drinking channel in the spout when the spout is in the open position. D2 is any amount greater than zero and may be, for example, 0.1-3 cm. Other values are possible, such as larger values for wide-mouth bottles, or smaller values for children's bottles.

When the spout is in its closed position, lying in depression 530, the drinking channel (e.g., 412 of FIG. 9) within the spout will not be in communication with aperture 550, thus making the bottle spill-proof. When the spout is in its open position pivoted upward from the cap 500, the drinking channel of the spout will adjoin with aperture 550, allowing liquid to be drawn from the bottle, through aperture 550 and out of the spout. Aperture 550 may optionally include a seal such as an O-ring at seat 552, near the junction of aperture 550 and pivoting area 534, to assist in making the bottle spill-proof. An air vent 570 is also shown in FIGS. 10 and 11, to facilitate the drawing of fluid from the bottle.

Cap 500 also includes threads 580 for coupling the cap 500 to a container such as, but not included to, a water bottle, a beverage cup, or other liquid container. The threads 580 are located in the region from the bottom surface 520 to the top surface 510 of the cap 500. Depression 530, or at least a majority of the depression 530, is elevated above the top surface 510. This elevation ensures that there is sufficient space for the threads 580 in the underside of cap 500, without increasing the height of the cap between top surface 510 and bottom surface 520. Depression 530 may be bordered by a raised lip 540 that encloses all the depression 530 as shown in this embodiment, or in other embodiments the raised lip 540 may surround only a portion of the depression 530. For example, the raised lip 540 may enclose the drinking end of the spout to protect it from contamination or damage. As seen in FIG. 11, the raised lip 540 is a wall in the vicinity of the depression only, and does not span across the entire top surface 510 of the cap 500. Thus, the elevated depression 530 provides functional support to the spout without aesthetically increasing the overall height of the cap. Reducing the amount of material added to the cap 500 reduces cost of the product. Elevating the depression 530 above the top surface 510 of the cap also provides space for the spout to extend across a majority of the diameter of the cap 500, such as at least 70% of the cap, since the depression does not impact the space for threads below the cap. Utilizing as much of the diameter of the cap as possible enables utilizing a longer spout than existing designs. A longer spout assists both in providing a longer drinking surface for the user, thus improving user comfort, and the longer spout also enables gaining leverage for lifting the spout. Yet the spout still fits within the diameter of the cap, so that cleanliness of the spout can be preserved within the depression and an overall compact design of the bottle is maintained.

FIG. 11 also shows holes 590 on the side walls of the cap 500, for receiving a handle. Positioning a handle at the perimeter of the cap 500 allows more space for the spout on the top surface 510, and consequently a longer spout length as described above. A handle on the perimeter also enables the handle to have a larger radius, thus improving user comfort. For example, a user may hold the handle (e.g., handle 150 of FIG. 4) with four fingers rather than one finger as in existing loop handle designs. The handle may be coupled to holes 590 with mating snap-fit protrusions, pins, or other means. In yet other embodiments, a strap may be coupled to the cap instead of a handle.

In other embodiments, the spout design described herein may be utilized with a proportionally larger cap. In such embodiments, the spout may occupy a smaller portion of the cap diameter while still maintaining the design features such as an oblique channel and offset drinking aperture. A large cap may be utilized in, for example, a bulk fluid storage container or a liquid dispensing carton. A large cap may also be used in, for example, a wide-mouth beverage container to facilitate ease of filling or cleaning the container.

The various components of the cap assembly in this disclosure, such as the spout, cap and drinking tube, may be made of suitable plastics including but not limited to polypropylene, silicone, polyethylene, polycarbonate, or nylon. In other embodiments, the components may be made from, for example, glass, wood, stainless steel, aluminum, or titanium. The components may be produced by, for example, injection molding or other plastic manufacturing methods known in the art.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the scope of the present invention, which is more particularly set forth in the appended claims. Furthermore, those of ordinary skill in the art will appreciate that the foregoing description is by way of example only, and is not intended to limit the invention.

What is claimed is:

1. A fluid container cover comprising:

a spout comprising a drinking portion, an actuation portion and a channel through the spout, wherein the actuation portion is inclined with respect to the drinking portion, and wherein the channel encompasses an oblique angle; and a cap having an aperture, wherein the aperture forms a passageway through a thickness of the cap;

wherein the spout is pivotally coupled to the cap at a fulcrum point, wherein the fulcrum point is laterally offset from the aperture, the lateral offset being in a radial direction with respect to a circumference of the cap;

wherein the spout is capable of being actuated from a closed position to an open position by an external force applied on the actuation portion, wherein the drinking portion of the spout is capable of being rotated substantially more than 90 degrees to the open position; and wherein the channel adjoins the aperture when the spout is in the open position.

2. The cover of claim 1 wherein fulcrum point is offset from the aperture by at least 0.1 cm.

3. The cover of claim 1 wherein the oblique angle is between 150 to 180 degrees.

4. The cover of claim 1 wherein the actuation portion is elevated above the cap when the spout is in the closed position.

5. The cover of claim 1 further comprising a depression in the cap, wherein the spout is seated in the depression, and wherein the depression comprises a raised lip enclosing at least a portion of the spout when the spout is in the closed position, and wherein the raised lip is elevated above a top surface of the cap.

6. The cover of claim 1 wherein the external force is a pushing force.

7. A drinking container cover comprising:

a cap adapted to be coupled to a drinking container; and a spout having a drinking end, an actuation end and a fulcrum point, wherein the spout is pivotally coupled to the cap at the fulcrum point, and wherein the spout further comprises a channel extending through the spout from the actuation end to the drinking end of the spout;

wherein the cap comprises an aperture forming a passageway that allows fluid to pass from an underside of the cap and through the spout;

wherein the fulcrum point of the spout is positioned between the aperture in the cap and the actuation end of the spout, the fulcrum being laterally offset from the aperture in a radial direction with respect to a circumference of the cap;

wherein the spout is capable of being actuated by an external pushing force applied on the spout near the actuation end of the spout;

wherein the spout moves from a closed position to an open position when actuated; and wherein when in the open position, (i) the aperture in the cap is in fluid communication with the channel through the spout and (ii) the drinking end of the spout is rotated substantially more than 90 degrees from the closed position.

8. The cover of claim 7 wherein the channel comprises a path from the actuation end to the drinking end of the spout, wherein the path is non-linear.

9. The cover of claim 7 wherein the drinking end is pivoted upward with respect to the cap when the spout moves to the open position.

10. The cover of claim 7 wherein the cap further comprises a raised lip forming a depression configured to receive the spout, wherein the raised lip is elevated above a top surface of the cap.

11. The cover of claim 7 wherein the spout extends across a majority of the diameter of the cap.

12. The cover of claim 7 wherein the fulcrum point is laterally offset from the aperture by a distance greater than zero.

13. A drinking container cover comprising:

a spout having a drinking end, an actuation end and a spout length between the drinking end and the actuation end, the spout comprising:

a channel through the spout length;

a first coupling element located at a first distance from a back end of the spout, wherein the back end is opposite the drinking end; and an actuation area, wherein the actuation area includes an actuation portion extending from the actuation end of the spout to less than the first distance; and a cap having a top surface and an underside, wherein the cap is adapted to be coupled to a drinking container, the cap comprising:

a depression on the top surface of the cap, wherein the depression is shaped to receive the spout, wherein the depression has a second coupling element that is configured to pivotally receive the first coupling element; and an aperture extending from the underside of the cap to the depression, wherein the aperture is laterally offset from the second coupling element, the lateral offset being in a radial direction with respect to a circumference of the cap;

wherein the spout is capable of being actuated by exerting a pushing force on the actuation area, wherein actuation of the spout pivots the spout from a closed position to an open position, wherein the drinking end of the spout is pivoted upward with respect to the cap and rotates substantially more than 90 degrees to the open position, and wherein the channel adjoins with the aperture when the spout is in the open position.

14. The cover of claim 13 wherein the first distance is at least 0.5 cm.

15. The cover of claim 13 wherein the actuation area is elevated above the top surface of the cap in the closed position, wherein when the spout is in the closed position, a height from a bottom surface of the cap to the actuation area enables a user to actuate the actuation area and hold the drinking container with a one-handed operation.

16. The cover of claim 13 wherein the depression comprises a raised lip above the top surface of the cap, wherein the raised lip surrounds the drinking end of the spout.

17. The cover of claim 13 wherein the depression comprises a pivoting area in which the actuation area of the spout rotates when the spout moves between the closed position and the open position.

18. The cover of claim 13 wherein the channel extends from the drinking end to the actuation end of the spout, and wherein the channel forms an oblique angle.

19. The cover of claim 18 wherein the oblique angle is at least 150 degrees.

* * * * *